United States Patent [19]

Heinemann et al.

[11] Patent Number: 4,464,112

[45] Date of Patent: Aug. 7, 1984

[54] APPARATUS FOR INTRODUCING FINE MATERIAL INTO A COMBUSTION ZONE

[75] Inventors: Otto Heinemann, Ennigerloh; Heinz-Dieter Baldus, Ahlen; Heinz-Herbert Schmits, Rheda-Wiedenbrück, all of Fed. Rep. of Germany

[73] Assignee: Krupp Polysius AG, Beckum, Fed. Rep. of Germany

[21] Appl. No.: 412,705

[22] Filed: Aug. 30, 1982

[30] Foreign Application Priority Data

Sep. 16, 1981 [DE] Fed. Rep. of Germany ..... 3136766
Nov. 30, 1981 [DE] Fed. Rep. of Germany ..... 3147374

[51] Int. Cl.[3] ..... F27B 7/02
[52] U.S. Cl. ..... 432/106; 432/58
[58] Field of Search ..... 432/14, 58, 106

[56] References Cited

U.S. PATENT DOCUMENTS 3,975,148 8/1976 Fukuda et al. ..... 432/106
4,257,766 3/1981 Ritzmann et al. ..... 432/106
4,310,299 1/1982 Binasik et al. ..... 432/106

*Primary Examiner*—John J. Camby
*Attorney, Agent, or Firm*—Learman & McCulloch

[57] ABSTRACT

The invention relates to apparatus for introducing fine material into a combustion zone by means of an air duct which has a constriction in the region of its junction with the material duct in such a way that the rate of flow is considerably increased at the point where the material is introduced and this favors the loosening of the material stream and the delivery of the material to the combustion zone.

21 Claims, 13 Drawing Figures

APPARATUS FOR INTRODUCING FINE MATERIAL INTO A COMBUSTION ZONE

The invention relates to apparatus for introducing fine material into a combustion zone by means of an air stream, containing an air duct which is connected to the combustion zone and into which a material duct opens.

Such a combustion zone can serve for example for precalcination of preheated cement raw material and can be formed by the exhaust gas conduit of a rotary kiln which leads to a multi-stage cyclone preheater. In such a case the air duct can be formed by the exhaust air duct of a cooler arranged after the rotary kiln and the material duct can be formed by the material discharge duct of the second lowest stage of the cyclone preheater.

Such an arrangement is for example the subject matter of German Offenlegungsschrift No. 27 52 323.5 in the name of the assignee of the present invention.

The introduction of the fine material into the combustion zone can cause difficulties. Since on the one hand the smallest possible quantity of air and accordingly a high material charge in the air stream are used and since on the other hand the fine material emerges from the material duct in the form of a relatively compact stream of material, there is a danger—particularly in view of varying operating conditions—that the material is not satisfactorily caught up by the air or gas stream and is not fully loosened or is unevenly distributed on arrival in the combustion zone. In extreme cases this can lead to a considerable proportion of the material not passing properly through the combustion zone but in the case of the example described in the introduction it falls directly out of the combustion zone into the rotary kiln.

The object of the invention, therefore, is to avoid these disadvantages and construct apparatus of the type referred to in the introduction in such a way that the fine material is satisfactorily loosened and reliably introduced into the combustion zone.

This object is achieved according to the invention in that the air duct narrows or is constricted in the region where the material duct opens into it, thus increasing the rate of air flow. This increase in the rate of air flow in the air duct favours the loosening of the compact stream of material, even distribution over the whole cross-section of the duct and reliable delivery of the material to the combustion zone.

The nozzle-like narrowing of the air duct in the region where the material duct opens into it can be constructed in the form of a Venturi tube or can be formed by a nozzle with an adjustable double-flap valve. In this way the desired acceleration and retarding of the gas stream is achieved with a relatively low energy consumption, and the construction with a double-flap valve offers particularly advantageous possibilities for adjusting the nozzle and thus the rate of air flow in the region of the narrowing of the duct.

The narrowing of the duct in the form of a Venturi tube can have a symmetrical inlet cone (with a half angular aperture of 10° to 30°) or an asymmetrical inlet cone (with a single-sided angular aperture of 10° to 30°).

In the embodiment with the double-flap valve the nozzle can have a substantially straight pipe section with a rectangular or round cross-section.

In addition, in both embodiments a symmetrical diffuser (with a half angular aperture of 10° to 30°) or an asymmetrical diffuser (with a single-sided angular aperture of 0° to 30°) can be provided in the region between the narrowing of the duct and the combustion zone.

As regards the shape of the cross-section of the Venturi tube, various constructions are possible within the scope of the invention and these are described on the basis of several embodiments which are shown in the drawings.

A particular advantage of the solution according to the invention also resides in the improvement in operating conditions under partial load. Here the generally lower gas speed in the air duct is increased by the nozzle-like narrowing in the region where the material duct opens into the air duct to the extent that the quantity of material which is without exception smaller under partial load is in any case satisfactorily taken up and delivered to the combustion zone.

Advantageous embodiments of the invention are described in connection with the description of several embodiments explained with the aid of the drawings, in which FIG. 1 shows a vertical section through a combustion zone with the apparatus according to the invention for the delivery of fine material, in an embodiment of the nozzle-like narrowing in the form of a Venturi tube;

FIGS. 2 and 3 show schematic representations of two variants of the narrowing of the air duct in the form of a Venturi tube;

FIGS. 4*a* to 7*b* show cross-sectional shapes of different air ducts;

Figure 1:
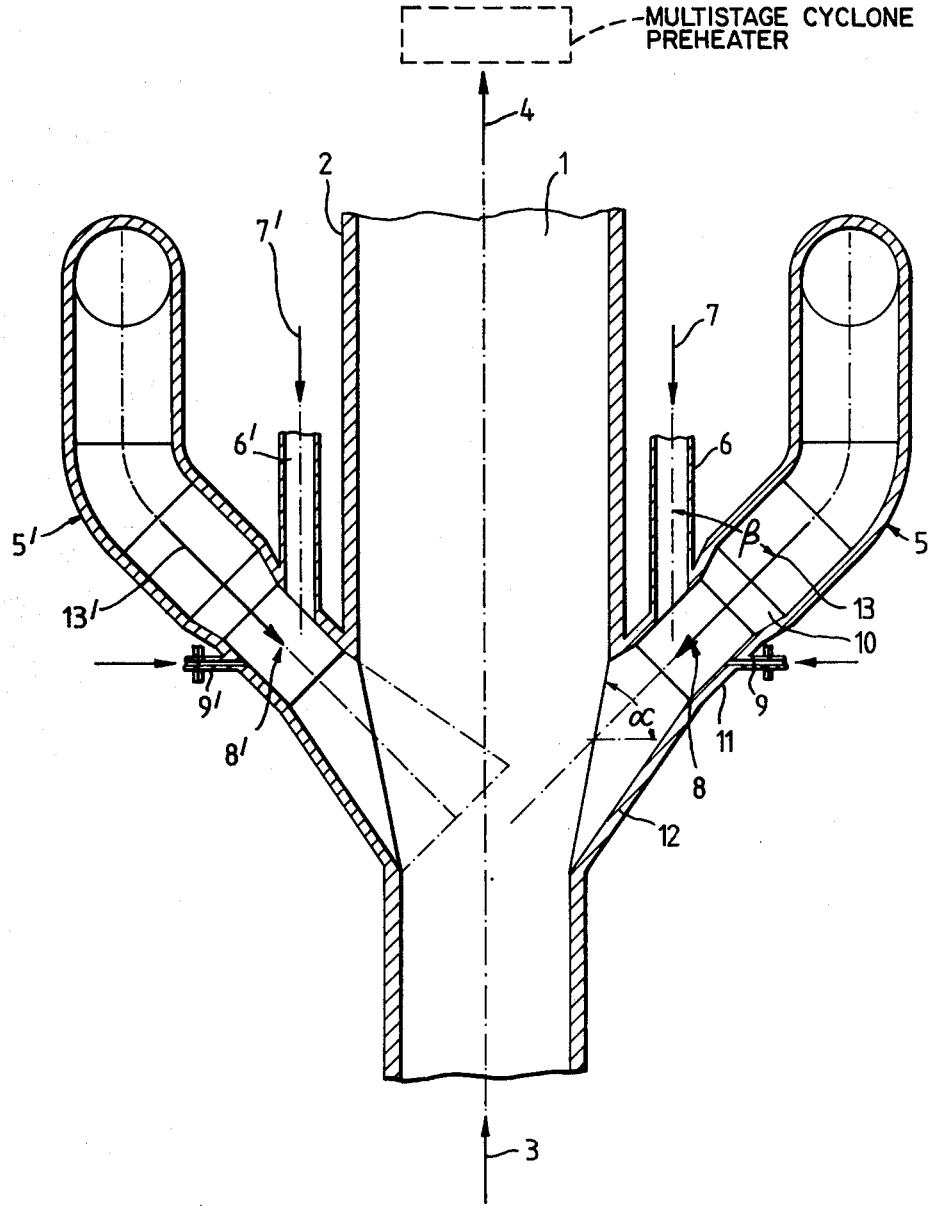

In the embodiment according to FIG. 1 a combustion zone 1 is formed by the exhaust gas conduit 2 extending from a rotary kiln. The exhaust gas from this rotary kiln flows towards the combustion zone 1 from below (arrow 3) and after passing through the combustion zone 1 flows toward (arrow 4) the lowest stage of a multi-stage cyclone preheater.

Two ducts 5, 5' which are two branches of an air duct extending from a cooler arranged after the rotary kiln, supply the exhaust air from this cooler to the combustion zone 1 as so-called tertiary air, and open into the exhaust gas duct 2 at points on the periphery thereof approximately opposite one another.

Material ducts 6, 6' through which the preheated material discharged from the second lowest stage of the cyclone preheater is delivered to the combustion zone 1 each open from above into the ducts 5, 5' (the streams of material are designated by the arrows 7, 7' and the air flow in the ducts 5, 5' is designated by the arrows 8, 8').

In each of the ducts 5, 5' there is a burner 9, 9' through which additional fuel which is burnt in the combustion zone 1 is introduced.

The arrangement described above can serve in particular for precalcination of preheated cement raw material as has been described in detail in German Offenlegungsschrift No. 27 52 323.5. The raw material which has been preheated in the cyclone preheater is heated to a high temperature in the combustion zone 1 by the hot exhaust gases from the kiln and the additional fuel introduced via the burners 9, 9' and is calcined to a large extent before it is deposited in the lowest stage of the cyclone preheater and delivered to the rotary kiln for final burning.

According to the invention the air ducts 5, 5' have a nozzle-like narrowing constriction which increases the rate of air flow and in this embodiment (FIG. 1) is constructed in each case in the form of a Venturi tube in the region where the material ducts 6, 6' open into the said air ducts. Since these two components are arranged in mirror image and are of identical construction it is sufficient in the following description to refer only to the Venturi tube belonging to the duct 5.

The Venturi tube contains an inlet cone 10, a nozzle portion 11 of narrowed cross-section and a diffuser 12. The burner 9 is arranged in the first region of the nozzle portion 11 having a narrowed cross-section, approximately in the zone of the wall of the Venturi tube lying opposite the junction with the material duct 6. The longitudinal axis 13 of the Venturi tube is inclined by an angle $\alpha$ of 20° to 70° relative to the horizontal, whilst the material duct 6 forms an angle $\beta$ of approximately 70° to 20° with the longitudinal axis 13 of the Venturi tube in the region where it opens into the tube.

In the embodiment shown in FIG. 1 the Venturi tube is provided with a symmetrical inlet cone 10 and symmetrical diffuser 12. Two variants of the embodiment shown in FIG. 1 (with a Venturi tube) are illustrated in FIGS. 2 and 3.

Figures 2, 3:
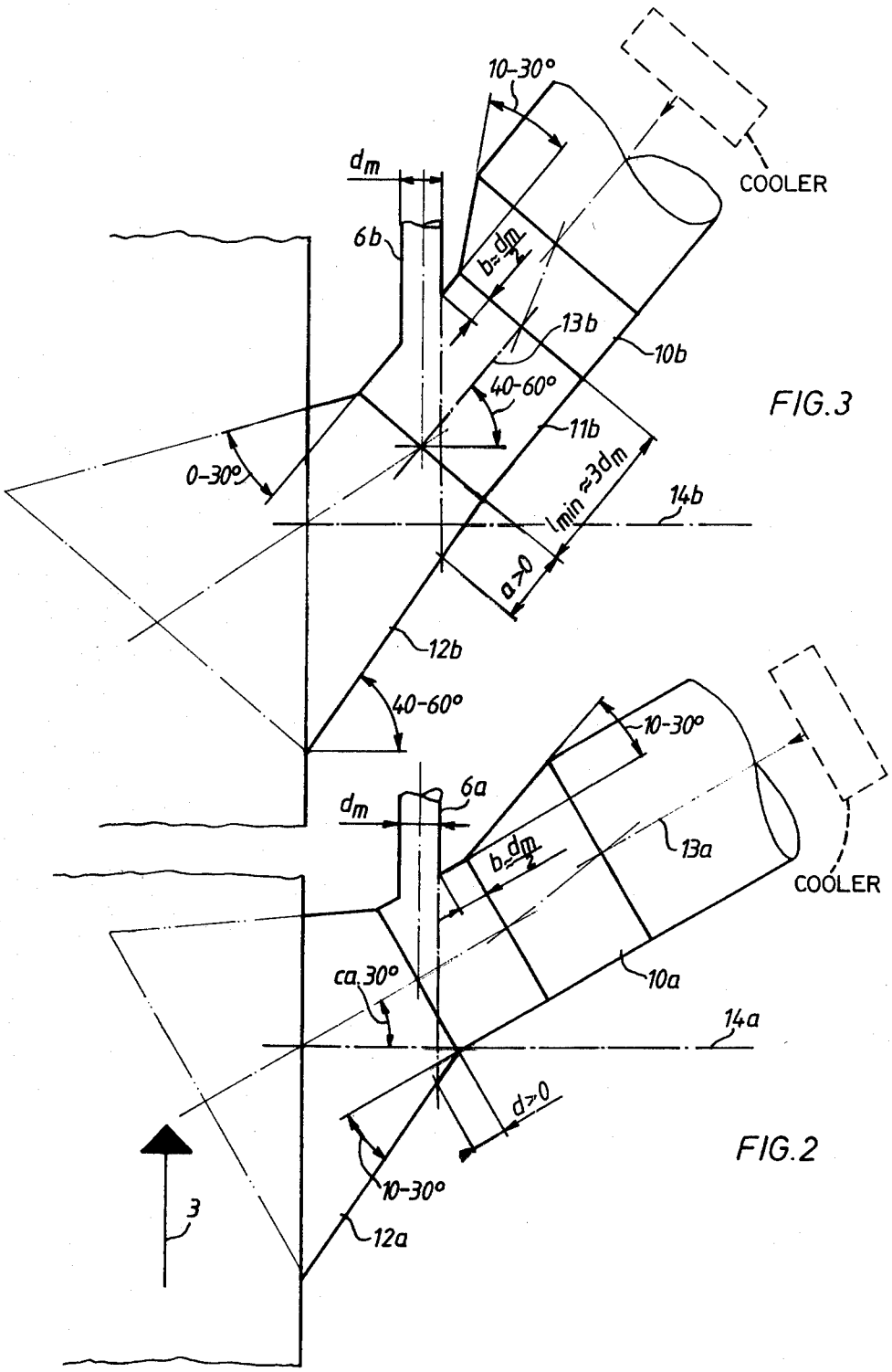

FIG. 2 shows one variant in which the Venturi tube has an asymmetrical inlet cone 10*a* (with a single-sided angular aperture of 10° to 30°) and a symmetrical diffuser 12*a* (with a half angular aperture of 10° to 30°). The longitudinal axis 13*a* of the Venturi tube is here inclined by an angle of approximately 30° relative to the horizontal. The axis 14*a* of the burner (cf. burner 9 in FIG. 1) runs approximately horizontally.

The dimension b (cf. FIG. 2) corresponds approximately to half the value of $d_m$ (diameter of the material duct 6*a*) whilst the dimension d (cf. FIG. 2) is greater than 0. In this embodiment the material duct 6*a* forms an angle of approximately 60° with the longitudinal axis 13*a* of the Venturi tube and thus extends approximately vertically. The dimensions described provide an optimum loosening of the material in the gas stream which is accelerated by the nozzle-like narrowing of the duct.

In the further variant shown in FIG. 3 the Venturi tube is provided with an asymmetrical inlet cone 10*b* (with a single-sided angular aperture of 10° to 30°) and an asymmetrical diffuser 12*b* (with a single-sided angular aperture of 0° to 30°). The longitudinal axis 13*b* of the Venturi tube is inclined in the region of the narrowest nozzle portion by an angle of 40° to 60° relative to the horizontal. Here the burner axis 14*b* extends approximately horizontally. The material duct 6*b* extends approximately vertically and thus opens into the Venturi tube at an angle of 30° to 50°.

The minimum length l of the nozzle portion 11*b* with the narrowest cross-section amounts approximately to 3 times the value of the diameter $d_m$ of the material duct 6*b*. The dimension b (cf. FIG. 3) corresponds to approximately $\frac{1}{2}$ $d_m$. The dimension a is greater than 0.

The operating conditions in the embodiment according to FIG. 3 can be approximately as follows:

Speed of the tertiary air before the Venturi tube 15–30 m/s

Temperature of the tertiary air 600°–1000° C.

Speed of the tertiary air in the nozzle portion 11*b* having the narrowest cross-section 20–40 m/s Dust charge in the nozzle portion 11*b* approx. 2–4 kg/Nm$^3$ Temperature of the fine material delivered via the duct 6*b* 600°–700° C.

Speed of the exhaust gas from the kiln delivered to the combustion zone 15–35 m/s Temperature of this kiln exhaust gas 900°–1200° C.

Several embodiments of cross-sectional shapes of the Venturi tube are illustrated in FIGS. 4*a* to 7*b*.

Figure 4A:
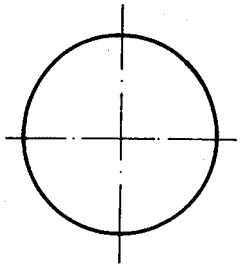
Figure 4B:
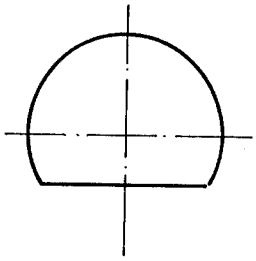

FIG. 4*a* shows a circular cross-section, FIG. 4*b* shows a cross-section in the form of a circular segment with a flat base. This construction provides a simple and stable walling and no ribbing of the sheet metal tube is necessary.

Figure 5A:
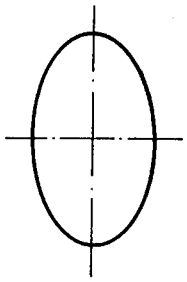
Figure 5B:
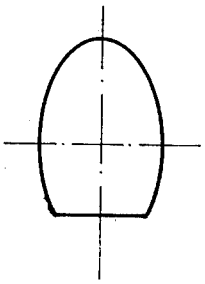

FIG. 5*a* shows an elliptical cross-section of the Venturi tube, FIG. 5*b* shows a cut-off elliptical cross-section with a flat base. With such a construction connections to narrow gas ducts can be produced and here too no ribbing of the sheet metal tube is necessary.

Figure 6A:
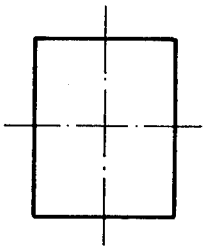
Figure 6B:
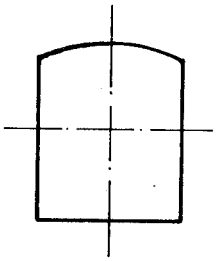

FIG. 6*a* shows a rectangular cross-section, FIG. 6*b* shows a rectangular cross-section which is slightly curved on the upper surface. Because of its simplicity such a construction is principally suited to smaller plant.

Figure 7A:
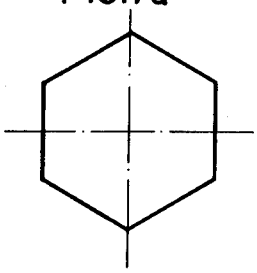
Figure 7B:
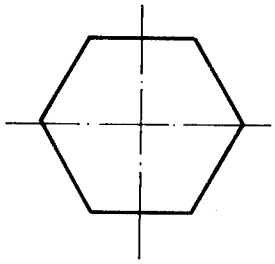

FIGS. 7*a* and 7*b* show two variants of Venturi tubes with prismatic cross-sections. The flat base favours the loosening of fine material passing through the tube, which is particularly important for the start of operation when there is no tertiary air flowing through the Venturi tube.

With the aid of FIGS. 8 and 9 a further embodiment will now be described in which the apparatus can have substantially the same basic construction as has been described in connection with FIG. 1. Accordingly the apparatus contains a combustion zone 21 which is formed by the exhaust gas conduit 22 from a rotary kiln from which the exhaust gas flows upwards into the combustion zone 21 (arrow 23) and after passing through this combustion zone 21 enters the lowest stage of the multi-stage cyclone preheater (arrow 24). Two branches 25, 25' which are connected to a cooler arranged after the rotary kiln and supply the exhaust air from the cooler to the combustion zone 1 as tertiary air open into the exhaust gas duct 22 at opposing points on the periphery thereof.

Material ducts 26, 26' (from the second lowest cyclone preheater stage) open from above into the ducts 25, 25'. The material streams are indicated by arrows 27, 27' and the air flow in the ducts 25, 25' is indicated by the arrows 28, 28'.

There is also a burner 29,29' in each of the ducts 25,25' by means of which additional fuel is introduced for burning in the combustion zone 21.

Figure 8:
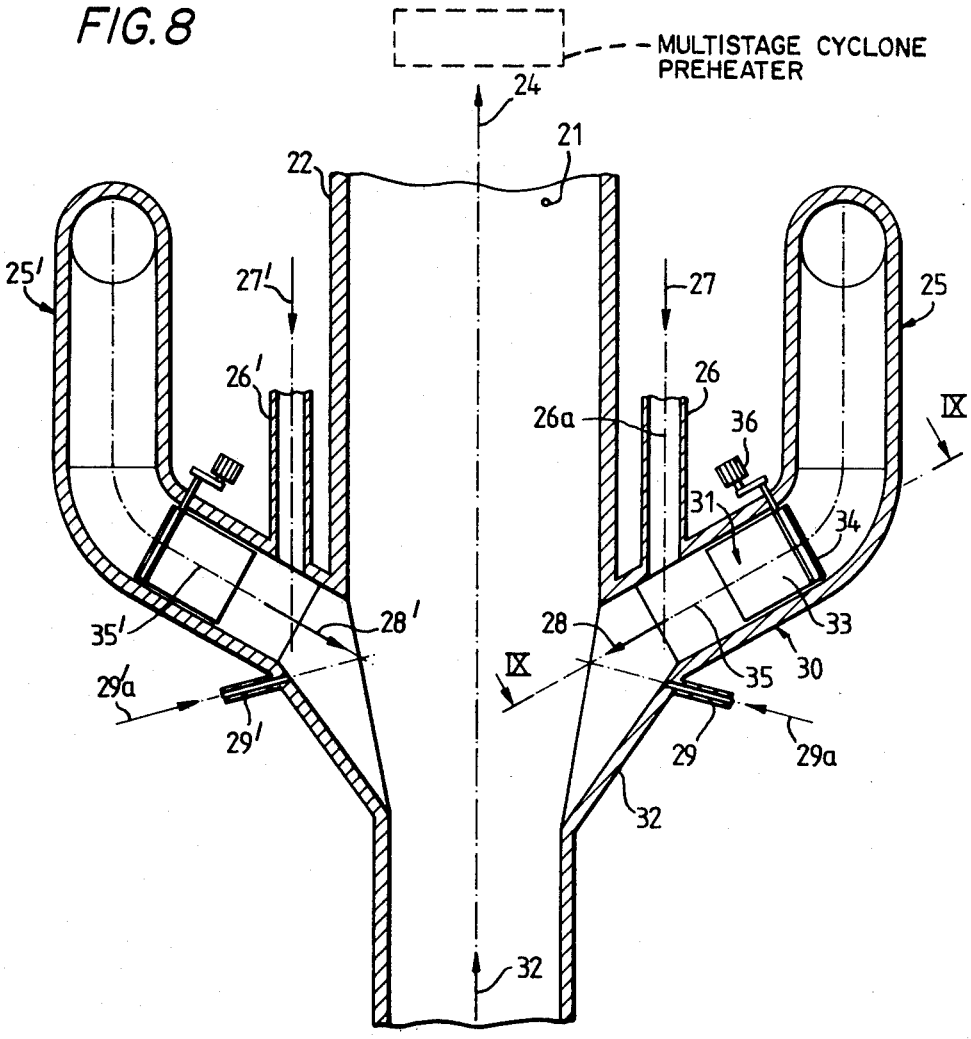
FIG. 8 shows a vertical section through a combustion zone according to a further embodiment of the invention, in which the narrowing of the air duct is formed by a nozzle with a double-flap valve.

This arrangement according to FIG. 8 serves in particular for the precalcination of preheated cement raw material as has already been described above in connection with FIG. 1.

Figure 9:
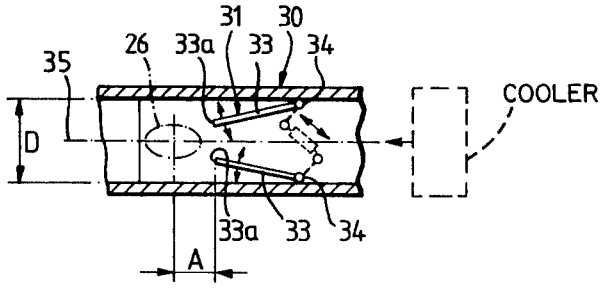
FIG. 9 shows a sectional view approximately along the line IX—IX in FIG. 8.

In contrast to the embodiment according to FIG. 1, in this embodiment according to FIGS. 8 and 9 the nozzle-like narrowing of each air duct 25, 25' provided in the region where the air duct opens into the material duct 26, 26' is formed by a nozzle 30 with an adjustable double-flap valve 31. The two nozzles 30 are of identical construction and arranged in mirror image to each other so that in the following description it is sufficient to refer to the nozzle 30 in the duct 25.

The nozzle 30 can have a substantially straight pipe section the cross-section of which is preferably rectangular but can also optionally be rounded in a suitable manner (circular or elliptical), but otherwise corresponds to the cross-sectional size of the duct 25. The approximately vertical material duct 26 is connected from above to this straight pipe section of the nozzle 30. A diffuser 32, which can be constructed in the same manner as has been described in connection with FIGS. 1 to 3, is provided between the end of the nozzle 30 adjacent to the exhaust gas duct 22 and the combustion zone 21 or the exhaust gas duct 22; in FIG. 8 the diffuser 32 is a asymmetrical construction.

The valve flaps 33 of the double-flap valve 31 lie in approximately vertical planes and can be pivoted about axes 34 which lie in the same planes as the valve flaps 33 and extend at right angles to the longitudinal axis 35 of the duct 25. According to the requirements or circumstances of use, these valve flaps 33 of the double-flap valve 31 can be moved synchronously or asynchronously either by hand or—as indicated in the drawing—with the aid of a servomotor 36 which facilitates automatic control or remote control.

The free ends **33*a* pointing in the direction of air flow (cf. arrow 28) extend into the region where the material duct 26 opens into the nozzle 30. In the plan projection according to FIG. 9, the free ends 33*a* of the valve flaps 33 have a distance A from the point of intersection of the longitudinal axis 26*a* of the material duct with the longitudinal axis 35 of the air duct 25, the distance A being a dimension between 0 and D, i.e. at most corresponding approximately to the internal diameter D of the air duct 25**.

Otherwise the arrangement of the branch ducts 25, 25' and their connection to the exhaust gas duct 22 and the appropriate material ducts 26, 26' can correspond to the examples given above according to FIGS. 1 to 3. This also applies in principle to the arrangement of the burners 29, 29' on the duct 25, 25'. However, in FIG. 8 each burner 29, 29' is arranged at a slightly lower point than that shown in FIG. 1, namely in the region of the upper end of the diffuser 30, so that the burner axis **29*a* or 29'*a* respectively intersects the lower extension of the longitudinal axis 35 or 35' respectively of the ducts 25, 25' at a point which lies at the point where the appropriate air duct 25, 25' opens into the combustion zone 21 or exhaust gas duct 22. It should be emphasised at this point that FIGS. 1 and 8 show arrangements for the junctions of the burners 9, 9' or 29, 29' with the appropriate ducts 5, 5' or 25, 25' in regions between which the most favourable possibilities for arrangement of the said burners lie in order to introduce the fuel for the precalcination—together with the preheated material—into the combustion zone 21**.

We claim:

1. In apparatus for heat treating fine-grained material having a conduit defining a combustion zone, at least one air duct in communication with said conduit adjacent said combustion zone, and a material supply duct in communication with said air duct at a region external of said conduit for delivering such material to said air duct, the improvement wherein said air duct has a constriction in cross-sectional area at said region to produce at said region an increase in the rate of air flow, said constriction having an inlet end and an outlet end, said outlet end communicating with said combustion zone via a divergent diffuser fixed to said conduit.

2. Apparatus according to claim 1 wherein said constriction is in the form of a Venturi tube.

3. Apparatus according to claim 1 wherein the inlet end of said constriction is in the form of a symmetrical cone.

4. Apparatus according to claim 3 wherein said cone has a half-angular aperture of between about 10° and 30°.

5. Apparatus according to claim 1 wherein said diffuser is symmetrical.

6. Apparatus according to claim 5 wherein said diffuser has a half angle aperture of between about 10° and 30°.

7. Apparatus according to claim 1 wherein said diffuser is asymmetrical.

8. Apparatus according to claim 7 wherein said diffuser has a single sided angular aperture of between about 0° and 30°.

9. Apparatus according to claim 1 wherein said constriction has a longitudinal axis inclined to the horizontal by an angle of between about 20° and 70° and said material duct forms an angle of between about 70° and 20° to said axis.

10. Apparatus according to claim 1 wherein said constriction comprises a nozzle in said air duct having pivotally adjustable double-flap valves.

11. Apparatus according to claim 10 wherein the flaps of said double-flap valves have free ends which extend in the direction of air flow and approximately to the region at which said material duct communicates with said air duct.

12. Apparatus according to claim 11 wherein the maximum distance between the free ends of said flaps and the longitudinal axis of said material duct corresponds substantially to the cross-sectional dimension of said air duct.

13. Apparatus according to claim 10 including means for adjusting the positions of said flaps.

14. Apparatus according to claim 10 including means operable selectively to adjust the positions of said flaps synchronously or asynchronously.

15. Apparatus according to claim 10 including burner means communicating with said air duct for discharging fuel into said air duct.

16. Apparatus according to claim 15 wherein said burner means communicates with said air duct between the inlet and outlet ends of said constriction.

17. Apparatus according to claim 15 wherein said burner means communicates with said air duct between the outlet end of said constriction and said conduit.

18. Apparatus according to claim 11 wherein said air duct is so dimensioned that the rate of flow of air in said constriction is between about 20 and 40 m/s.

19. In apparatus for heat treating fine-grained material having a conduit defining a combustion zone through which exhaust gases from a kiln flow toward and into a multi-stage preheater, at least one air duct extending from a cooler and communicating with said conduit at said combustion zone, and material supply duct means extending between said preheater and said air duct and communicating with the latter at a region adjacent but external of said conduit for delivering such material into said air duct, the improvement wherein said air duct has a constriction in its cross-sectional area at said region to produce an increase in the rate of air flow at said region, said constriction having an inlet end and an outlet end, said outlet end being fixed to said conduit at its preiphery.

20. Apparatus according to claim 19 including a second air duct corresponding to said one air duct and communicating with said conduit on that side of the latter opposite said one air duct.

21. Apparatus according to claim 19 wherein said one and said second air ducts are branches of a single duct communicating with said cooler.

* * * * *

UNITED STATES PATENT AND TRADEMARK OFFICE

CERTIFICATE OF CORRECTION

PATENT NO. : 4,464,112

DATED : August 7, 1984

INVENTOR(S) : Otto Heinemann et al

It is certified that error appears in the above-identified patent and that said Letters Patent is hereby corrected as shown below:

Column 5, line 8, change "a" to -- of --.

Column 6, line 44, change "11" to -- 1 --

Signed and Sealed this

*Eighth* Day of *January 1985*

[SEAL]

*Attest:*

*Attesting Officer*

GERALD J. MOSSINGHOFF

*Commissioner of Patents and Trademarks*